US007170019B2

(12) United States Patent
Wong et al.

(10) Patent No.: US 7,170,019 B2
(45) Date of Patent: Jan. 30, 2007

(54) INERTIA SWITCH AND FLASHING LIGHT SYSTEM

(75) Inventors: Wai Kai Wong, Kowloon (HK); Lai Cheong Mak, Kowloon (HK)

(73) Assignee: Cheerine Development (Hong Kong), Ltd., Hong Kong (HK)

( * ) Notice: Subject to any disclaimer, the term of this patent is extended or adjusted under 35 U.S.C. 154(b) by 0 days.

(21) Appl. No.: 10/620,001

(22) Filed: Jul. 14, 2003

(65) Prior Publication Data

US 2005/0011737 A1 Jan. 20, 2005

(51) Int. Cl.
*H01H 3/16* (2006.01)

(52) U.S. Cl. ..... 200/61.45 M; 200/61.52; 335/205; 362/103

(58) Field of Classification Search ..... 200/61.45 M, 200/61.45 R, 61.52, 61.53; 335/205–207, 335/302; 362/103, 200, 203, 276
See application file for complete search history.

(56) References Cited

U.S. PATENT DOCUMENTS

| | | | |
|---|---|---|---|
| 1,597,823 | A | 8/1926 | Randolph |
| 1,933,243 | A | 10/1933 | Merolis et al. |
| 2,572,760 | A | 10/1951 | Rikelman |
| 2,634,407 | A | 4/1953 | Johnson |
| 2,671,209 | A | 3/1954 | Habib |
| 2,671,847 | A | 3/1954 | Lerch |
| 2,816,284 | A | 12/1957 | Campanell |
| 2,849,819 | A | 9/1958 | Murphy et al. |
| 2,931,893 | A | 4/1960 | Arias et al. |
| 2,959,892 | A | 11/1960 | Johnson |
| 2,976,622 | A | 3/1961 | Shearouse |
| 3,008,038 | A | 11/1961 | Dickens et al. |
| 3,053,949 | A | 9/1962 | Johnson |
| 3,070,907 | A | 1/1963 | Rocco |
| 3,564,232 | A | 2/1971 | Ellerbe |
| 3,731,022 | A | 5/1973 | Loftus |
| 3,800,133 | A | 3/1974 | Duval |
| 3,893,247 | A | 7/1975 | Dana, III |
| 3,946,505 | A | 3/1976 | Dana, III |

(Continued)

FOREIGN PATENT DOCUMENTS

| | | | |
|---|---|---|---|
| CN | 2094892 | U | 2/1992 |

(Continued)

OTHER PUBLICATIONS

Combined Search and Examination Report, dated Jul. 15, 2003, for corresponding United Kingdom Application No. GB 0306157.9.

(Continued)

*Primary Examiner*—K. Lee
(74) *Attorney, Agent, or Firm*—Brinks Hofer Gilson & Lione

(57) ABSTRACT

Inertia switches in insulating housings are used to make or break electrical contact. The switches may be small in size, and may be used with flashing light systems in footwear or other articles. One embodiment is a directional switch sensitive to the orientation of the switch and the motion of the switch due to outside forces. Footwear with flashing light systems that use these inertia switches may make the wearer or user more visible at night, adding a measure of safety as well as fun. Flashing light systems using these inertia switches may also be used to illuminate personal accessories and articles of clothing.

12 Claims, 18 Drawing Sheets

U.S. PATENT DOCUMENTS 4,014,115 A 3/1977 Reichert
4,020,572 A 5/1977 Chiaramonte, Jr.
4,128,861 A 12/1978 Pelengaris
4,130,951 A 12/1978 Powell
4,158,922 A 6/1979 Dana, III
4,231,079 A 10/1980 Heminover
4,253,253 A 3/1981 McCormick
4,298,917 A 11/1981 Ware
4,308,572 A 12/1981 Davidson et al.
4,329,549 A * 5/1982 Breed ..... 200/61.45 M
4,350,853 A 9/1982 Ganyard
4,412,205 A 10/1983 Von Kemenczky
4,450,326 A * 5/1984 Ledger ..... 200/61.45 M
4,459,645 A 7/1984 Glatter
4,588,387 A 5/1986 Swenson
4,639,563 A * 1/1987 Gunther ..... 200/61.45 M
4,701,146 A 10/1987 Swenson
4,800,469 A 1/1989 Leon
4,848,009 A 7/1989 Rodgers
4,870,325 A 9/1989 Kazar
4,897,947 A 2/1990 Kass-Pious
4,948,929 A * 8/1990 Fukushima ..... 200/61.45 M
4,995,294 A 2/1991 Kashio et al.
5,016,144 A 5/1991 DiMaggio
5,033,212 A 7/1991 Evanyk
5,052,131 A 10/1991 Rondini
5,113,325 A 5/1992 Eisenbraun
5,188,447 A 2/1993 Chiang et al.
5,285,586 A 2/1994 Goldston et al.
5,303,131 A 4/1994 Wu
5,303,485 A 4/1994 Goldston et al.
5,313,187 A 5/1994 Choi et al.
5,343,190 A 8/1994 Rodgers
5,353,441 A 10/1994 Lazorchak
5,357,697 A 10/1994 Lin
5,371,662 A 12/1994 Shen-Ko
5,381,615 A 1/1995 MacMillan
5,393,943 A * 2/1995 Furukawa et al. ... 200/61.45 M
5,396,720 A 3/1995 Hwang et al.
5,400,232 A 3/1995 Wong
5,406,724 A 4/1995 Lin
5,408,764 A 4/1995 Wut
5,419,061 A 5/1995 Barrocas
5,422,628 A 6/1995 Rodgers
5,438,488 A 8/1995 Dion
5,438,493 A 8/1995 Tseng
5,455,749 A 10/1995 Ferber
5,456,032 A 10/1995 Matsumoto et al.
5,457,900 A 10/1995 Roy
5,461,188 A 10/1995 Drago et al.
5,463,260 A * 10/1995 Ono ..... 307/121
5,463,537 A 10/1995 Trattner et al.
5,465,197 A 11/1995 Chien
5,477,435 A 12/1995 Rapisarda
5,477,437 A 12/1995 Lach
5,483,759 A 1/1996 Silverman
5,485,358 A 1/1996 Chien
5,490,338 A 2/1996 Hwang et al.
5,495,136 A 2/1996 Chiang et al.
5,495,682 A 3/1996 Chen
5,500,635 A 3/1996 Mott
5,508,899 A 4/1996 McCormick
5,546,681 A 8/1996 Goldston et al.
5,550,721 A 8/1996 Rapisarda
5,566,479 A 10/1996 Gray et al.
5,575,554 A 11/1996 Guritz
5,577,828 A 11/1996 Nadel et al.
5,599,088 A 2/1997 Chien
5,604,999 A 2/1997 Barker
5,614,700 A * 3/1997 Moss et al. ..... 200/61.45 M
5,644,858 A 7/1997 Bemis
5,663,614 A 9/1997 Weng et al.
5,664,665 A * 9/1997 Kobayashi et al. .. 200/61.45 M
5,683,164 A 11/1997 Chien
5,709,464 A 1/1998 Tseng
5,732,486 A 3/1998 Rapisarda
5,746,499 A 5/1998 Ratcliffe et al.
5,746,500 A 5/1998 Chien
5,754,064 A 5/1998 Chien
5,758,946 A 6/1998 Chen
5,786,553 A 7/1998 Zakutin ..... 200/64.48
5,789,716 A 8/1998 Wang
5,812,063 A 9/1998 Weng et al.
5,813,148 A 9/1998 Guerra
5,866,987 A 2/1999 Wut
5,877,664 A * 3/1999 Jackson, Jr. ..... 335/205
5,883,347 A * 3/1999 Malesko et al. ..... 200/61.45 M
5,892,193 A * 4/1999 Norton ..... 200/61.53
5,894,201 A 4/1999 Wong
5,903,103 A 5/1999 Garner
5,932,975 A 8/1999 Wut
5,934,784 A 8/1999 Dion
5,955,712 A 9/1999 Zakutin
5,969,311 A 10/1999 Mader
5,969,479 A 10/1999 Wong
6,012,822 A 1/2000 Robinson
6,060,673 A 5/2000 Jackman
6,065,851 A 5/2000 So
6,104,140 A 8/2000 Wut et al.
6,130,593 A * 10/2000 Van Zeeland ..... 335/205
6,145,999 A 11/2000 Van Derlande
6,164,794 A 12/2000 Rodgers
RE37,220 E 6/2001 Rapisarda et al.
6,280,045 B1 8/2001 Anteby et al.
6,334,692 B1 1/2002 Hsueh ..... 362/116
6,335,498 B1 * 1/2002 James et al. ..... 200/61.45 M
6,348,766 B1 2/2002 Ohishi et al.
6,354,712 B1 3/2002 Anteby
6,360,615 B1 3/2002 Smela
6,408,545 B1 6/2002 Song
6,525,487 B2 2/2003 Wei
6,619,812 B2 9/2003 Rapisarda
2003/0137852 A1 7/2003 Rapisarda

FOREIGN PATENT DOCUMENTS

CN 2148388 Y 12/1993
CN 2196897 Y 5/1995
EP 0 121 026 A1 10/1984
EP 0 335 467 B1 10/1989
EP 0 773 529 A1 5/1997
GB 1 519 388 7/1978
GB 2 361 624 A 10/2001
JP 54-133766 10/1979
JP 55-80376 A 6/1980
JP 5-21188 A 1/1993
JP 10232635 9/1998
JP 2000182402 A 6/2000
WO WO 93/11681 6/1993

OTHER PUBLICATIONS

International Search Report for corresponding international patent application No. PCT/CN2004/000779, dated Dec. 2, 2004.

* cited by examiner

INERTIA SWITCH AND FLASHING LIGHT SYSTEM

FIELD OF THE INVENTION

The invention relates to the field of inertia switches, frequently used in flashing light systems which are assembled as a part of footwear, personal accessories, and other articles of clothing. The wearer of the footwear or other article begins a sequence of flashing lights by moving, for instance, by walking or running. The lights begin flashing in one or more sequences, adding interest and fun to the sport or activity in which the wearer is engaged.

BACKGROUND

The present invention is directed to inertia or motion switches and the flashing light systems in which such switches may often be used. Flashing light systems typically have a housing or case, a power supply, such as a battery, a control circuit, and one or more lamps. The lamps may be incandescent lamps or may be light-emitting diodes (LEDs), or any other types of lamps. The control circuit may be an integrated circuit or other control device that is used to turn the lamps on and off. A switch is necessary to activate the flashing light system.

Included in the many types of switches used in the prior art are mercury switches, now recognized as dangerous, such as those depicted in U.S. Pat. No. 4,848,009. An inertia switch requiring a hinge, a hinge arm, and a weight may be used, as depicted in U.S. Pat. No. 5,477,435. This switch appears to be useful for activating only one or two LEDs at a time, as opposed to more than one LED, or a series of separated LEDs. Touch switches may be used, requiring a user to press or touch a switch to activate the flashing light system, as demonstrated in U.S. Pat. No. 6,525,487. This type of switch detracts from the enjoyment of the flashing light system, because the user must constantly press the switch in order to begin a flashing sequence. Because of these deficiencies in the prior art, better inertia switches are required. These switches are useful in a variety of applications, including flashing light systems in footwear, flashing light systems that may be assembled into a variety of personal accessories or clothing type items, and used in many other ways.

BRIEF SUMMARY

One aspect of the invention is an inertia switch comprising a first conductive spring and a second, smaller conductive spring held within the first spring. The switch also comprises a first contact connected to the first spring and a second contact connected to the second spring, and an insulating directional regulator having an axial extension for only a portion of its circumference, the insulating directional regulator held between the first and second springs. Another aspect of the invention is a method of controlling a flashing light system, the method comprising mounting a first conductive spring inside a second conductive spring, and placing an insulating directional regulator having an axial extension for only a portion of its circumference between the conductive springs to form an inertia switch for a flashing light system. The method also comprises activating the flashing light system by causing motion of at least one spring in the inertia switch.

Another aspect of the invention is an inertia switch comprising a first coil spring having a first diameter and mounted on a first contact and a second coil spring having a second diameter mounted on a second contact, the coil springs each being electrically conductive. The inertia switch also comprises an insulating housing mounting the first and second contacts and separating the first contact and the second contact by a fixed distance, wherein the distance is between the sum of the first and second diameters and one-half the sum of the first and second diameters. Another aspect of the invention is a method of controlling a flashing light system, the method comprising placing a first contact inside a first electrically conductive coil spring, and placing a second contact inside a second electrically conductive coil spring. The method also comprises mounting the first contact and first spring and the second contact and second spring inside an electrically insulating housing, wherein the first contact and second contact are separated by a fixed distance between the sum of the first and second diameters and one-half the sum of the first and second diameters, to form an inertia switch for a flashing light system, and activating the flashing light system by causing motion of at least one spring in the inertia switch.

Another aspect of the invention is an inertia switch comprising an insulating housing, a first contact maintained at a fixed position at a proximal end of the housing, and a conductive leaf spring and a second contact, the second contact maintained at a fixed position at a distal end of the spring within the housing. The inertia switch also comprises a conductive mass mounted on the spring near the first contact, wherein the switch is normally open and is closed by motion of a user flexing the leaf spring, causing the mass to contact the first contact.

Another aspect of the invention is an inertia switch comprising an insulating housing and a first and a second contact mounted side by side in the housing. The inertia switch also comprises a first magnet mounted to the housing, and a second magnet disposed within the housing, the first magnet and the second magnet opposed by a repulsive force between the magnets, wherein the switch is normally open and motion of the user causes the second magnet to move, contacting both contacts and closing the switch. Another aspect of the invention is a method of controlling a flashing light system, the method comprising mounting two conductors side by side in an insulating housing and placing a first magnet and a second magnet in the housing, the first magnet and the second magnet opposed by a repulsive force between the magnets, to form an inertia switch for a flashing light system. The method also comprises closing the inertia switch through motion of a user, causing the first magnet to contact both contacts simultaneously and activate the flashing light system.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

DETAILED DESCRIPTION OF THE DRAWINGS AND THE PRESENTLY PREFERRED EMBODIMENTS

Flashing light systems are used in footwear and other articles of clothing to add sparkle and interest, to enhance safety of the user, and to make physical activity fun. These activities may include walking, running, dancing or other sports. While shoes and footwear are the most popular applications for flashing light systems, such systems may also be used in other articles of clothing or accessories worn by people. These may include belts, back-packs, vests, safety-vests, hair clasps, hair clips, and the like.

Figure 1:
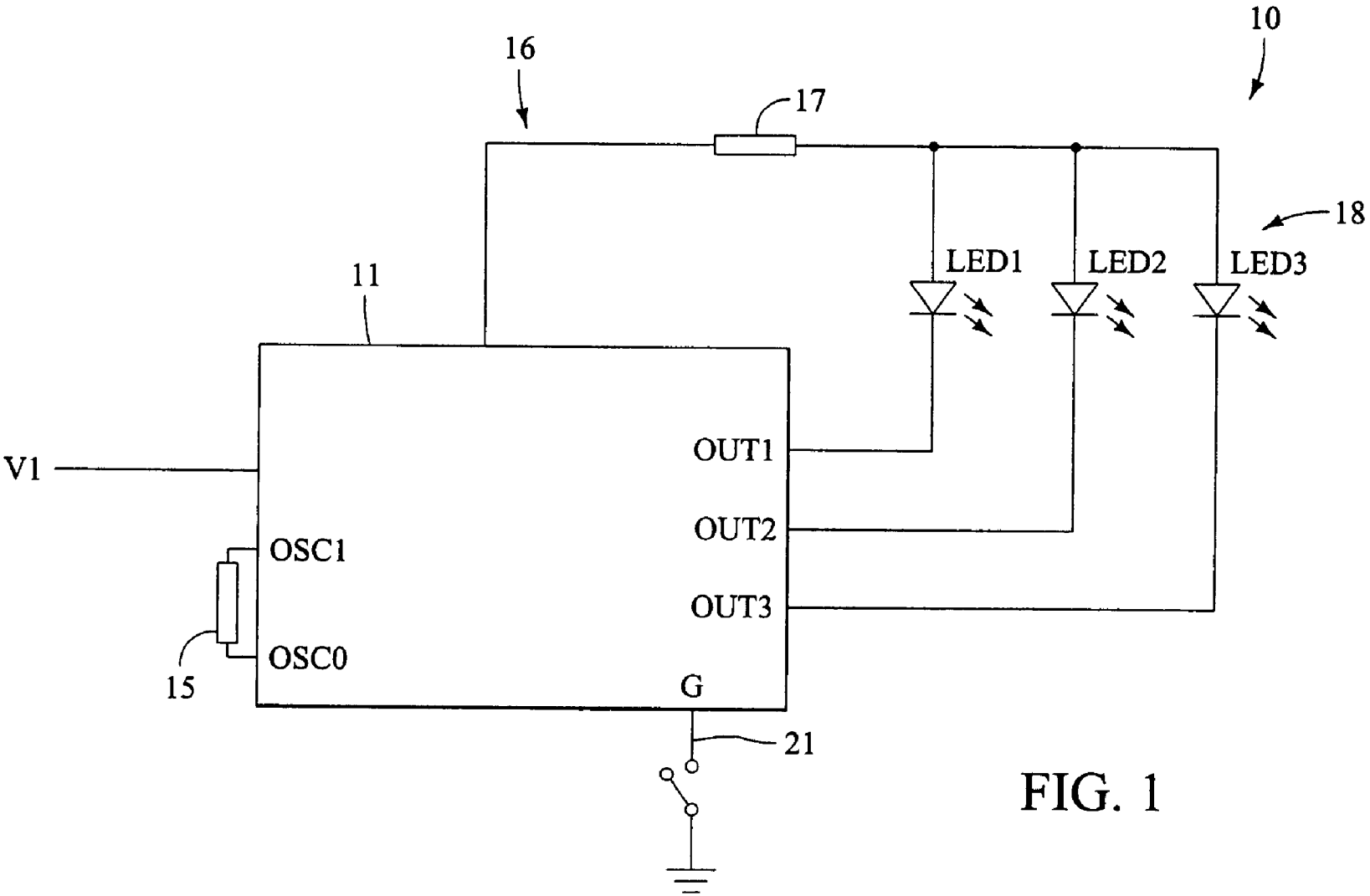
FIG. 1 is a schematic diagram of a flashing light system in which inertia switches of the present invention are useful.

Flashing light systems are typically actuated by a switch, such as a touch switch, a toggle switch, or an inertia switch. A flashing light system 10 is depicted in FIG. 1. Flashing light system 10 includes an integrated circuit 11, an inertia switch 21, a voltage source VI, and an oscillator resistor 15. The system depicted also has an output 16, a current-limiting resistor 17, and three LEDs 18 connected to the integrated circuit. The voltage source V1 and the ground shown may be the anode and cathode of a battery. The pattern of illumination, of one or more of the LEDs, may be changed by clocking the flashing light system by repeatedly closing and opening inertia switch 21.

The flashing light system depicted in FIG. 1 may be used in footwear or other articles. A user activates flashing light system 10 by tripping inertia switch 21. This completes the circuit to ground between power supply V1 and LEDs 18. The circuit may include transistors or other gates made as a part of integrated circuit or controller 11 to control the illumination of the LEDs. Power supply VI is typically connected to the anodes of LEDs 18 through current-limiting resistor 17 between output 16 and circuits OUT1, OUT2, OUT3 connected to the cathodes of LEDs 18. Controller 11 may also have a control resistor 15. Other aspects and details of flashing light systems are detailed in co-pending patent application Ser. No. 10/235,880, filed Sep. 4, 2002, entitled Article with Flashing Lights, and Ser. No. 10/370,209, filed Feb. 18, 2003, entitled Flashing Light Systems with Power Selection. Controller 11 may be an integrated circuit, such as MC14017BCP, CD4107AF, made by many manufacturers, or may be a custom or application specific integrated circuit, or may be a CMOS circuit, such as a CMOS 8560 circuit. Other examples include M1320 and M1389 RC integrated circuits are made by MOSdesign Semiconductor Corp., Taipei, Taiwan. Another example is a controller made with CMOS technology, such as model EM78P153S, made by EMC Corp., Taipei, Taiwan.

Figure 2:
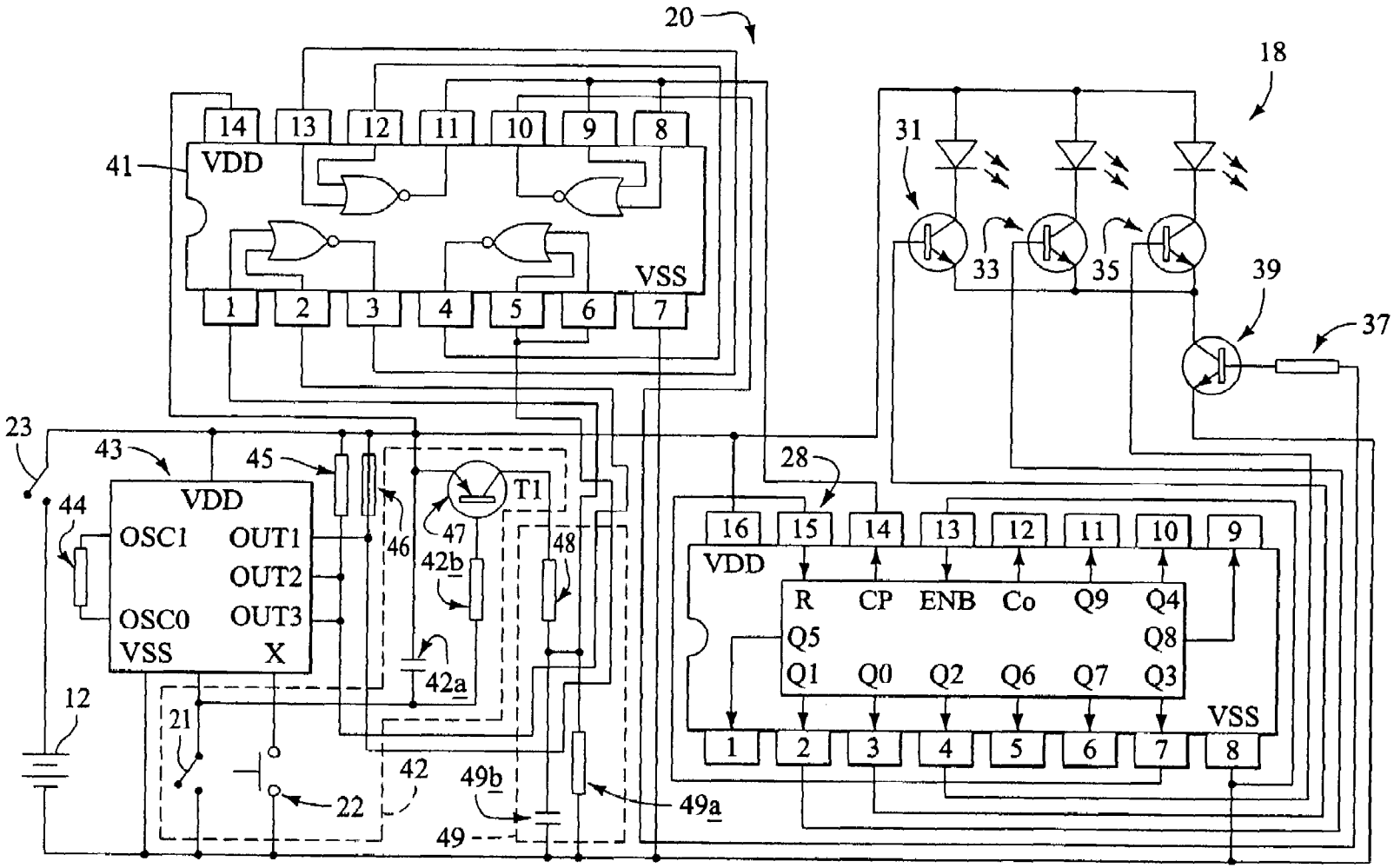
FIG. 2 is a schematic diagram of a second flashing light system in which inertia switches of the present invention are useful.

A more complex circuit for a flashing light system is depicted in FIG. 2. Flashing light system 20 includes a battery 12, LEDs 18, an inertia switch 21, a touch switch 22, a triggering circuit 42, a pulse generating circuit 41, flash driver 43, resistors 45, 46, and an output controller or decade counter 28. There may also be a toggle switch 23. This circuit connects the LEDs 18 by means of secondary control transistors 31, 33, 35 through primary control transistors 39 and 47. The circuit includes flash driver 43 and its oscillator resistor 44, providing a clock signal to the pulse generating circuit 41 and the output controller 28. In addition, a control circuit is provided by means of an RC circuit 49 (in dashed lines), including resistor 49*a* and capacitor 49*b*. If the inertia switch is closed for a period of time, or for several short periods, capacitor 49*b* charges. The LEDs illuminate until the inertia switch opens. When the switch opens, the charge on the capacitor enables one of more of LEDs 18 to continue to illuminate. Decade counter 28 may be an integrated circuit, such as an MC14017BCP, CD4107AF, made by many manufacturers, or may be a custom or application specific integrated circuit, or may be a CMOS circuit. Quad NOR gate 41 may be a CD4001 quad NOR gate, made by many manufacturers, or a similar product. Flash drive 43 may be one of several possible circuits, as outlined above for FIG. 1.

The triggering circuit 42 (in dashed lines) includes switches 21, 22, primary control transistor 47, capacitor 42*a* and resistor 42*b*. The emitter of primary control transistor 47 connects to the positive terminal of battery 12, while the collector of primary control transistor 47 is connected to resistor 48. As the voltage across resistor 48 and capacitor 42*a* rises, flash driver 43 receives a signal from triggering circuit 42 and generates output signals to the pulse generating circuit 41 through its outputs OUT1, OUT2 and OUT3. Decade counter 28 enables secondary control transistors 31, 33, 35, each turning on an LED, and enabling them to flash in desired patterns or sequences. Flash driver 43 or system 20 may also include a memory for storing patterns of flashing. Primary control transistor 39 acts as a switch, connected with its collector to the emitters of the LEDs 18 and with its emitter to the negative terminal of the power supply 12. Control resistor 37 limits the voltage to the gate of transistor 39 from pulse-generating circuit 41.

Figure 3:
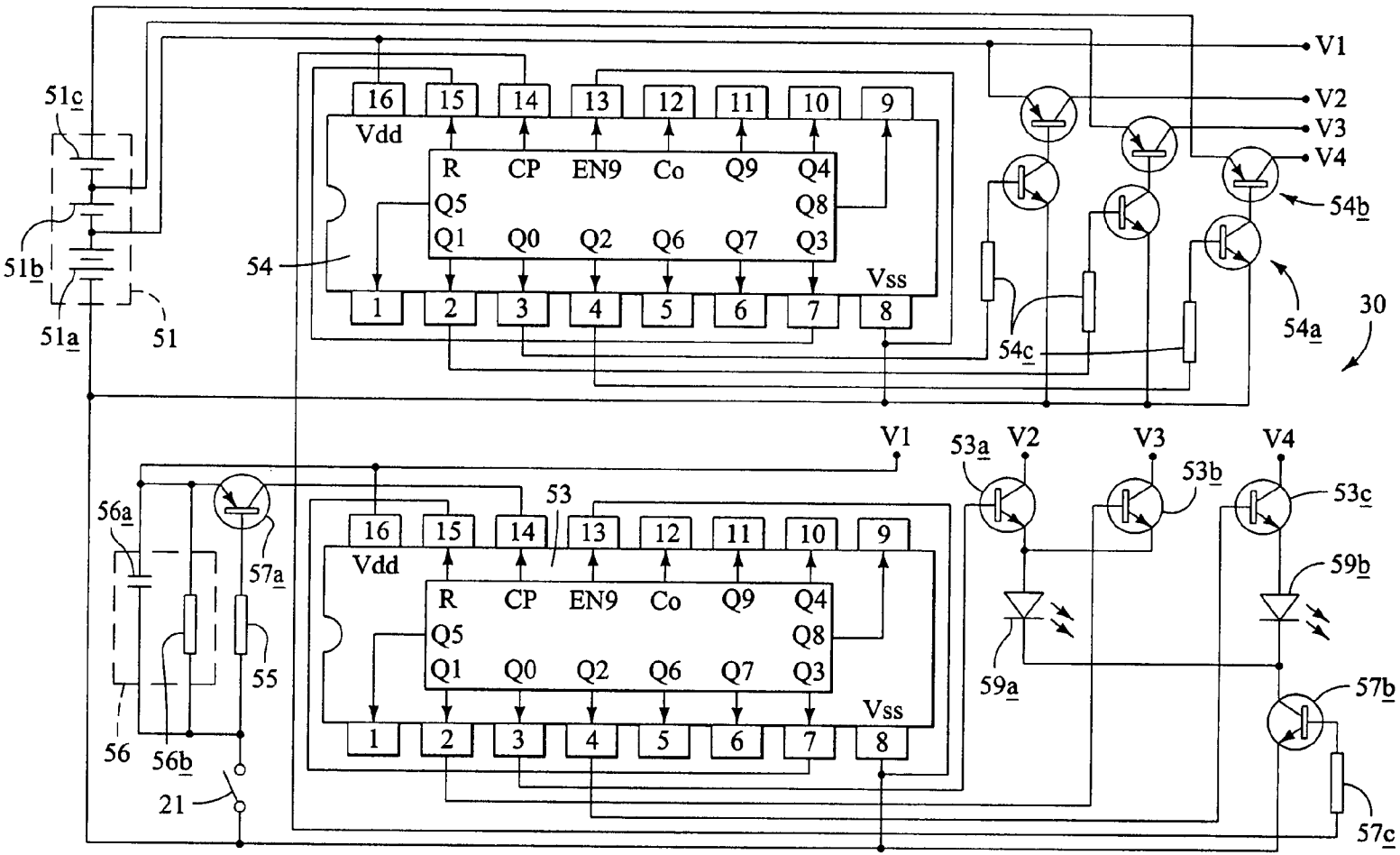
FIG. 3 is a schematic diagram of another embodiment of a flashing light system in which inertia switches of the present invention are useful.

FIG. 3 depicts another embodiment of a system using an inertia switch to flash lights. FIG. 3 is a block diagram of a system 30 for selecting a power or voltage level to LEDs 59*a* and 59*b* using a decade counter 53 and a second decade counter 54. In a preferred embodiment, the decade counters are CD4017 integrated circuits, available from several manufacturers. In FIG. 3, there is a power supply 51 comprising a 3V battery 51*a* connected in series with two 1.5V batteries 51*b* and 51*c*. As shown in FIG. 3, a first voltage, such as 3V, is routed to pin 16 of decade counter 54 for control power, and a second voltage, which may be 3V, is also routed to a voltage supply transistor 54*b* and to a pin labeled V1. In the illustrated embodiment, the first voltage and the second voltage are substantially 3V. Other voltages may be used in other embodiments.

The other voltages from power supply 51 are also routed to other voltage supply transistors 54*b*. The voltages available from the collectors of supply transistors 54*b* are thus 3V, 4.5V and 6V, less a small voltage drop across the transistors themselves. Thus, the voltages at pins V1, V2, V3 and V4, in one example of this embodiment, are 3V, 3V, 4.5V and 6V. Other voltages may be used, with V2 and V3 preferably being different voltages.

The supply transistors 54*b* are controlled by control transistors 54*a*, connected to decade counter 54 through control resistors 54*c*, as shown. Power is routed from the upper V1–V4 pins connected to decade counter 54 to lower V1–V4 pins connected to the decade counter 53. Connections may be made by traces on a printed circuit board, or any other convenient method.

The system 30 is controlled by a switch 21, which may be an inertia switch, or may be a touch switch or a toggle switch, or other suitable switch. Switch 21 completes a circuit with primary gate or primary control transistor 57*a* through resistor 55. There is also a control circuit 56 with a capacitor 56*a* and a resistor 56*b*. Decade counter 53 receives voltage V1 at pin 16 and is otherwise connected as shown in FIG. 3. The circuit also includes secondary control transistor or gate 57*b* and current-limiting resistor 57*c* connected to the cathodes of LEDs 59*a*, 59*b*. In this embodiment, the anode of LED 59*a* is connected to the emitters of two secondary control transistors 53*a* and 53*b*, one of which connects to voltage V2 and the other of which connects to voltage V3. Thus, if decade counter 53 turns on transistor 53*a*, connected to V2, LED 59*a* will receive about 3V. However, if decade counter 53 turns on transistor 53*b*, connected to V3, then LED 59*a* will receive 4.5 volts. If decade counter 53 turns on transistor 53*c*, LED 59*b* will receive voltage V4, in this example about 6V. In this embodiment, transistors 53*a*, 53*b* and 53*c* are turned on when sufficient base current and base-emitter voltage are provided to place the devices in a forward conducting state.

A user activates switch 21 and the flashing light system either by touching a touch switch, or activating an inertia switch, for instance, by walking or running. The control circuit 56 is then activated by charging capacitor 56*a* and turning on primary gate or primary control transistor 57*a*. Decade counters 53 and 54 are activated, and at least one LED will light up for a period of time until capacitor 56*a* is discharged. Decade counter 54 will turn on transistor 57*b*, while decade counter 53 will turn on secondary control transistors or gates 53*a*, 53*b* and 53*c* to flash LEDs 59*a* and 59*b*. In this example, it will be understood that more LEDs may also be connected, some with more than one power level such as LED 59*a*, and some LEDs may be connected only to a single power level, as shown with LED 59*b*. The system may then cause the LEDs to flash in a sequence. The LEDs may receive a greater voltage and illuminate more brightly, or a lesser voltage and illuminate less brightly. Of course, some LEDs may be designed for a higher voltage and used in the circuit depicted in FIG. 3, while other LEDs may be designed for a lower voltage.

Figure 4:
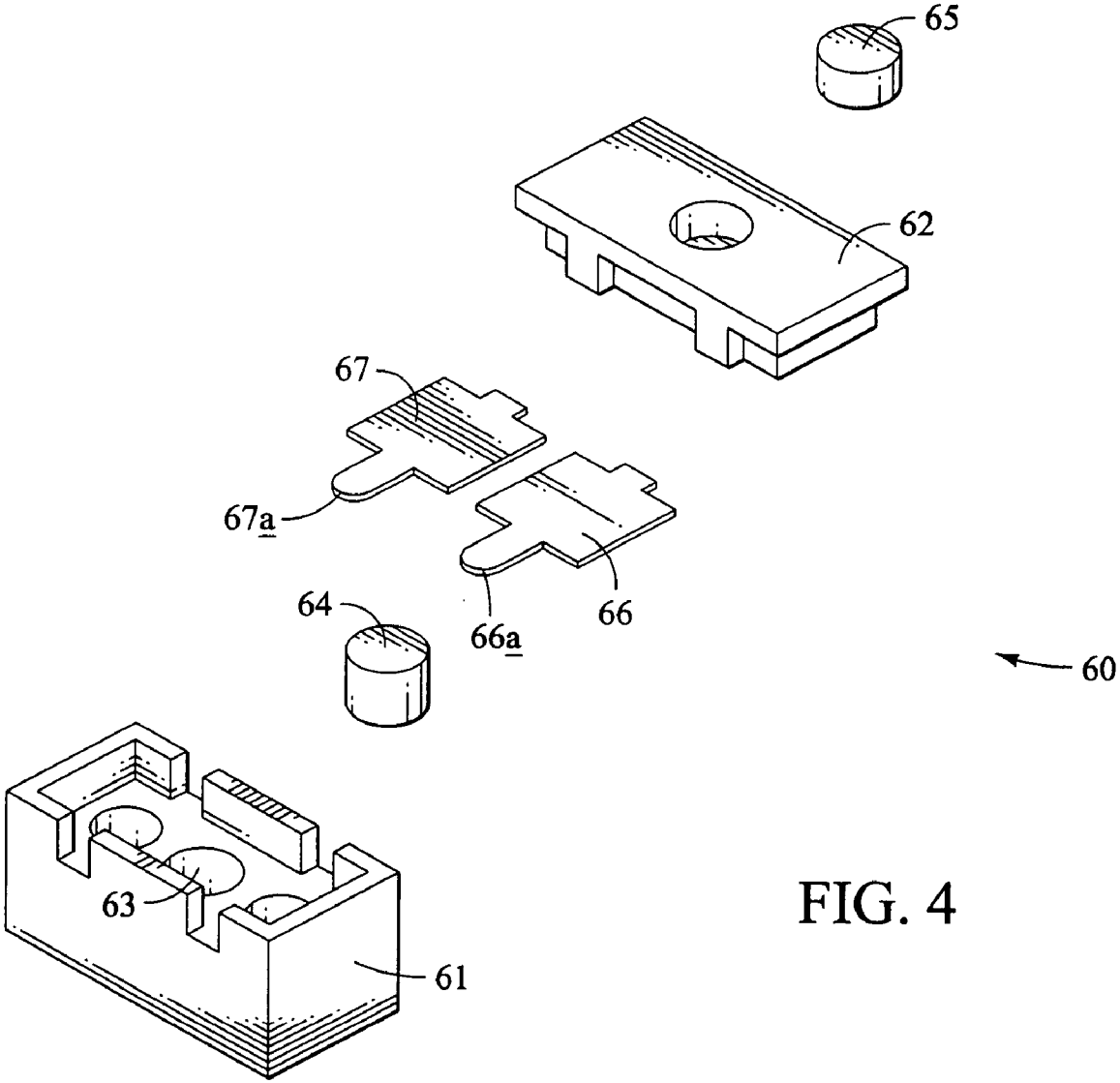
FIG. 4 is an exploded perspective view of a first embodiment of an inertia switch useful in a flashing light system.
Figure 5:
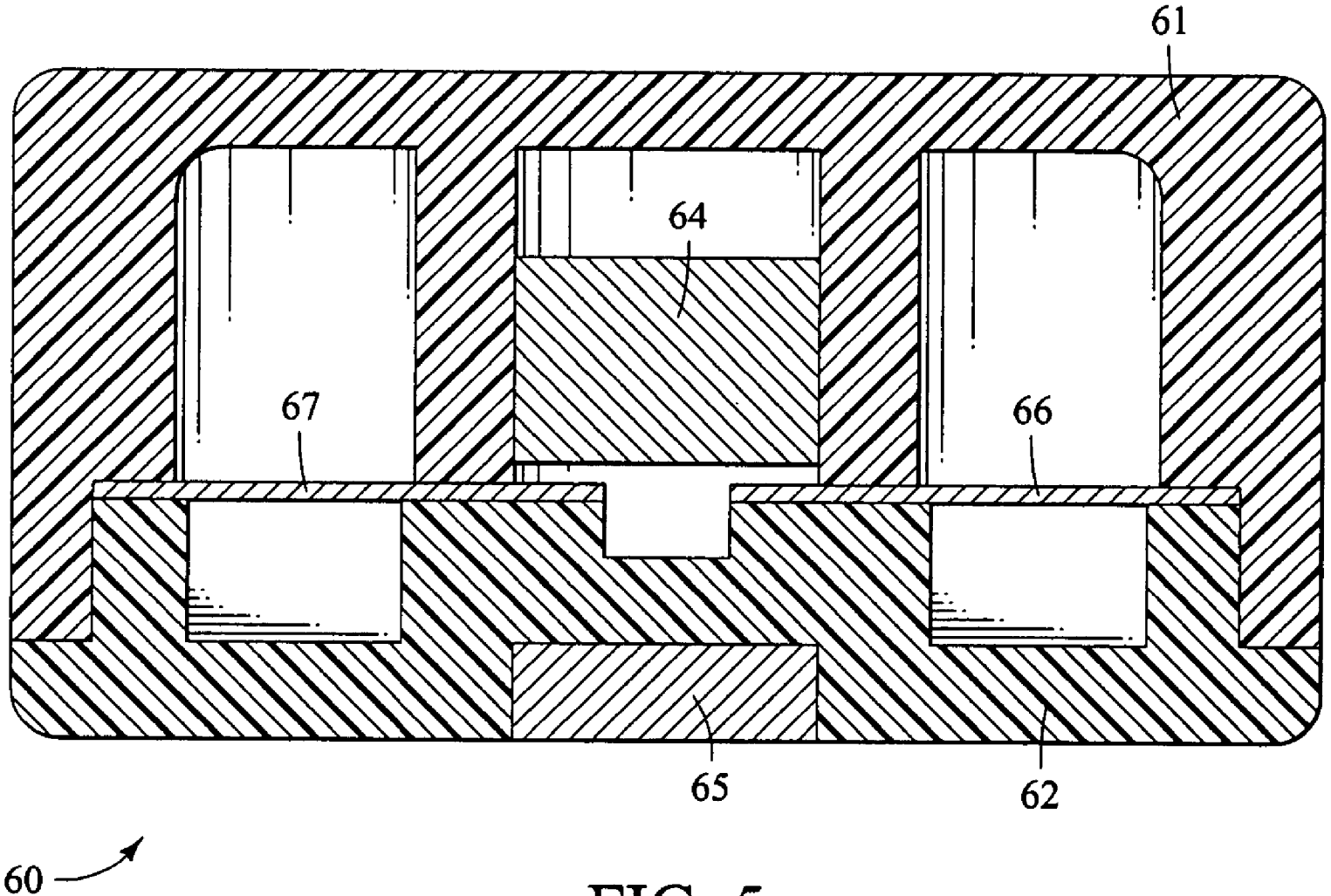
FIG. 5 is a cross-sectional view of the embodiment of FIG. 4.

An improved inertia switch with magnets may be used in the flashing light systems described above. FIG. 4 depicts one such inertia switch 60, which includes a nonconductive housing 61, a nonconductive top cover 62 for the housing, an upper magnet 64 and a lower magnet 65, and two contacts 66, 67. The narrower portions 66*a*, 67*a*, of the contacts protrude through the housing and may be soldered to make external connections to a flashing light system. FIG. 5 depicts a cross-section of the assembled switch 60. The two magnets are held with similar poles facing, such as N—N or S—S, for a repulsive effect. Preferably upper magnet 64 disposed in cavity 63 has a greater mass or is larger in size than lower magnet 65. Magnet 64 slides up and down in cavity 63 in response to inertial forces to activate the switch. An inertia switch 60, oriented as shown in FIG. 5 with the upper magnet held in repulsion from contacts 66, 67 by lower magnet 65, is assembled into a flashing light system, such as those described in FIGS. 1–3. When a user walks or moves, inertia may cause the mass of upper magnet 64 to move downward, overcoming the repulsive force of lower magnet 65, and contacting contacts 66 and 67. Magnet 64 is electrically conductive, and may also be plated or otherwise treated to enhance its conductivity. Contacts 66 and 67 are thus closed when contacted by magnet 64, acting as an inertia switch and activating a flashing light system of which it is a part. In one embodiment, the magnets are 4 mm (about 0.16 inches) in diameter and are about 2.7 mm (about 0.11 inches) high. The housing is about 13 mm (about 0.51 inches) long, about 6 mm (about 0.24 inches) wide, and about 7 mm (about 0.28 inches) high. The boxy, rectangular shape of the housing is not required, but is convenient for manufacturing and installation. Other configurations, such as round, ovate or other shapes, may also be used. The extra cavities lighten the mass of the switch.

Figure 6:
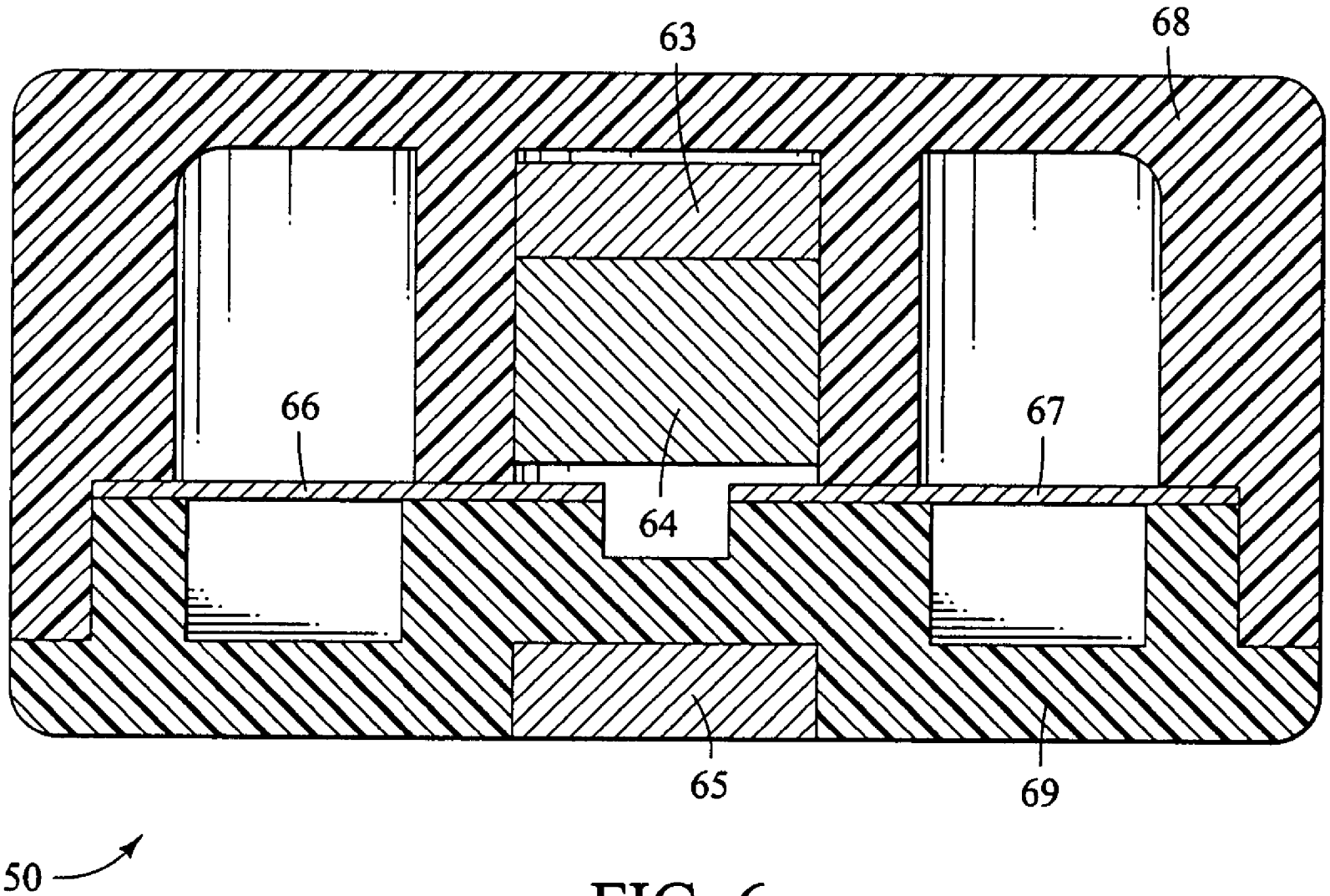
FIG. 6 is a cross-sectional view of another embodiment of an improved inertia switch similar to the embodiment of FIGS. 4 and 5.

Another embodiment of an inertia switch 50 is depicted in FIG. 6. Improved inertia switch 50 is very similar to inertia switch 60 depicted in FIGS. 4–5. Inertia switch 50 has an electrically nonconductive or insulating upper housing 68, nonconductive or insulating lower housing 69, upper magnet 64, lower magnet 65, and contacts 66, 67. In this embodiment, a mass or weight 63 is also added to upper magnet 64. In this way, the sensitivity of the magnetic switch may be adjusted. For example, if the weight of weight 63 increases, the sensitivity of the switch increases. Weight 63 may be any useful material, conductive or nonconductive. Steel or iron will work well as a weight in the application.

Figure 7:
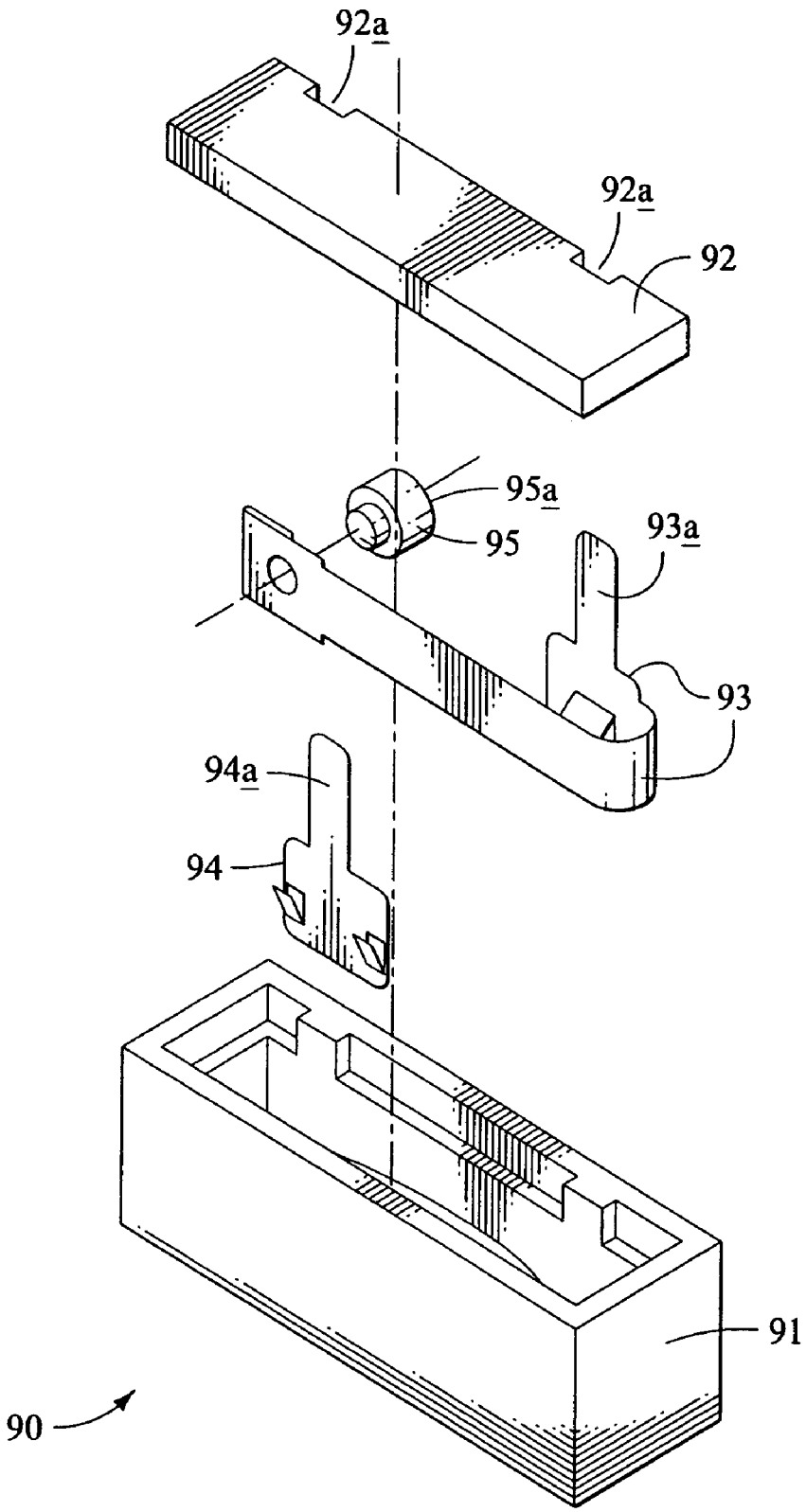
FIG. 7 is a perspective, exploded view of another embodiment of an inertia switch useful in flashing light systems.
Figure 8:
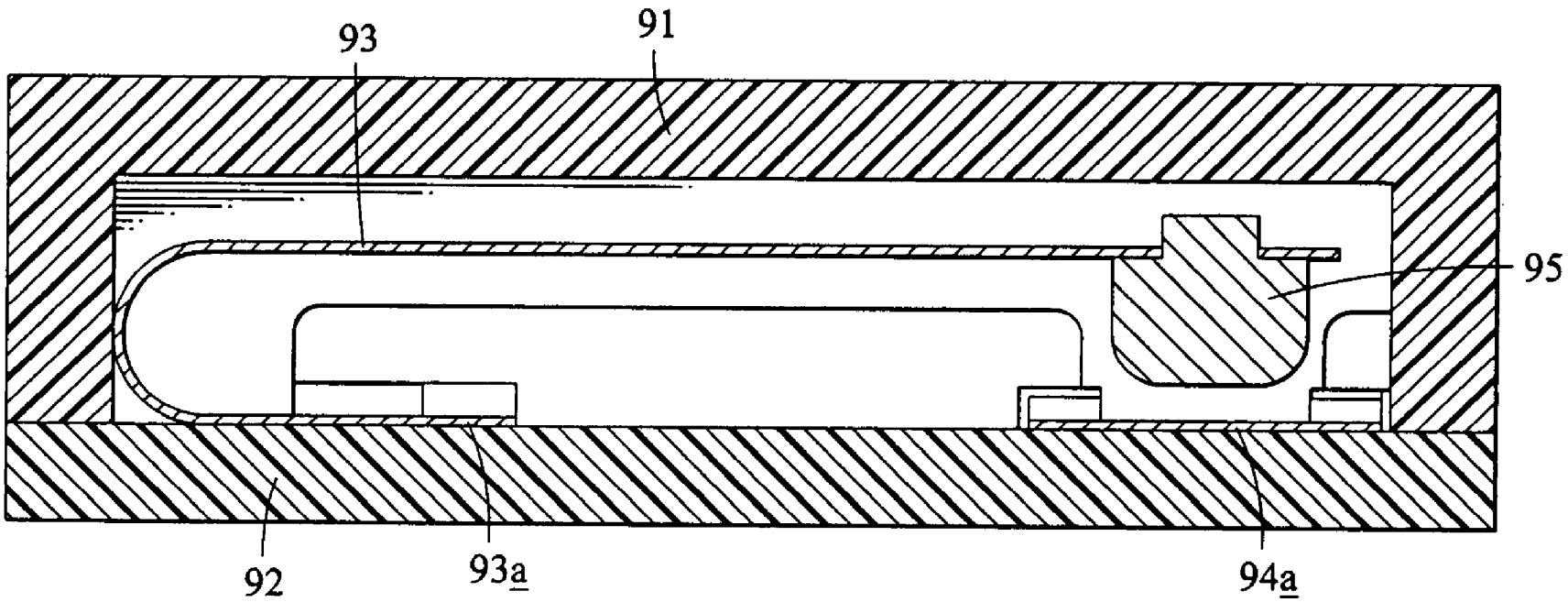
FIG. 8 is a cross-sectional view of the embodiment of FIG. 7.

Another inertia spring switch is depicted in FIGS. 7 and 8. The switch 90 includes a nonconductive housing 91 and nonconductive cap 92. The switch also includes a conductive spring 93 with a first contact 93*a*, a conductor 94 with a second contact 94*a*, and a mass or weight 95. Spring 93 and first contact 93*a* may be integral, such as by being formed from a stamping, or they may be separate pieces that are made and subsequently joined, as by soldering or welding. Weight 95 is also made of a conductive material. Thus, the assembly of spring 93, contact 93*a*, and weight 95 is also conductive. Any of these parts, such as conductor 94 and contact 94*a*, or the assembled version of spring 93, contact 93*a* and weight 95 may be plated or otherwise treated to enhance conductivity or resistance to corrosion.

Contacts 93*a*, 94*a* protrude through slots 92*a* in cap 92 and are soldered or otherwise assembled to a flashing light system to act as an inertia switch for the system. FIG. 8 depicts a cross-sectional view of switch 90, in which spring 93 is arranged so that weight 95 is suspended above conductor 94. When a user moves, weight 95 will move downwardly from the force of inertia, and will make contact with conductor 94. This closes the switch between contacts 93*a*, 94*a*, activating the flashing light system of which the switch is a part. In a preferred embodiment, the housing is about 17 mm (0.67 inches) long, about 5 mm (0.20 inches) wide, and about 5 mm (0.20 inches) high. In one embodiment, the weight is about 0.05 g. The amount of weight or mass of weight 95 and the length and flexural stiffness of spring 93 will determine the relative sensitivity of the switch. In use, as depicted in FIG. 8, the weight or mass 95 will move up and down, in the directions of the arrows, and face 95*a* of the mass will make electrical contact with contact 95*a* to close the inertia switch.

Figure 9:
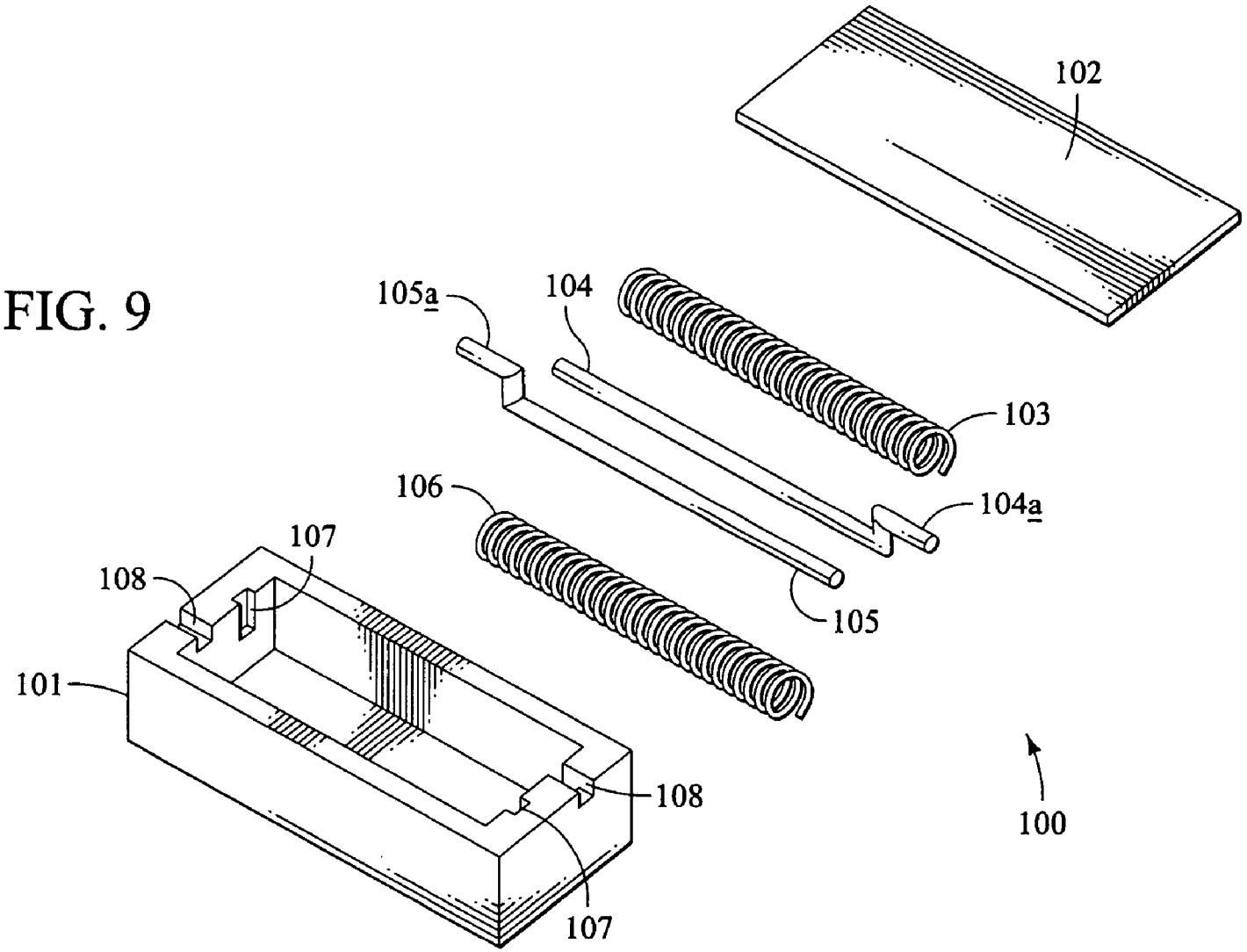
FIG. 9 is an exploded view of another embodiment of an inertia switch useful in flashing light systems.
Figure 10:
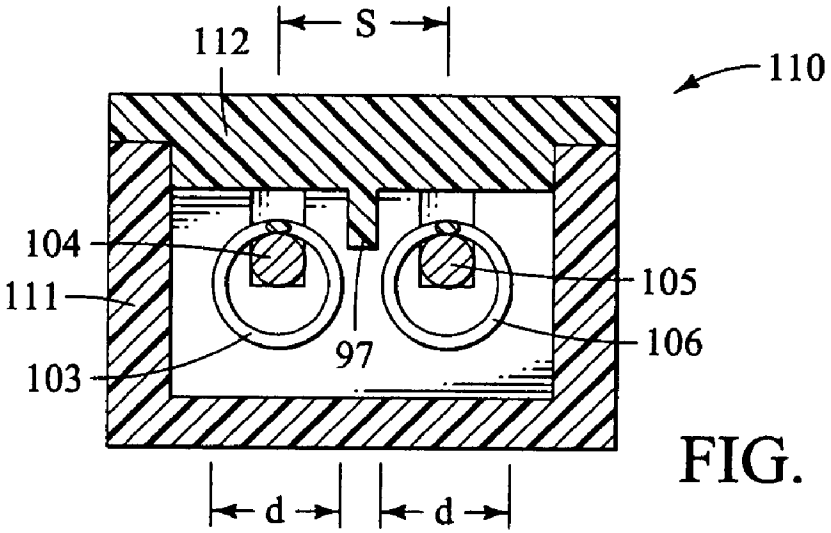
FIG. 10 is an end cross-sectional view of another embodiment.
Figure 11:
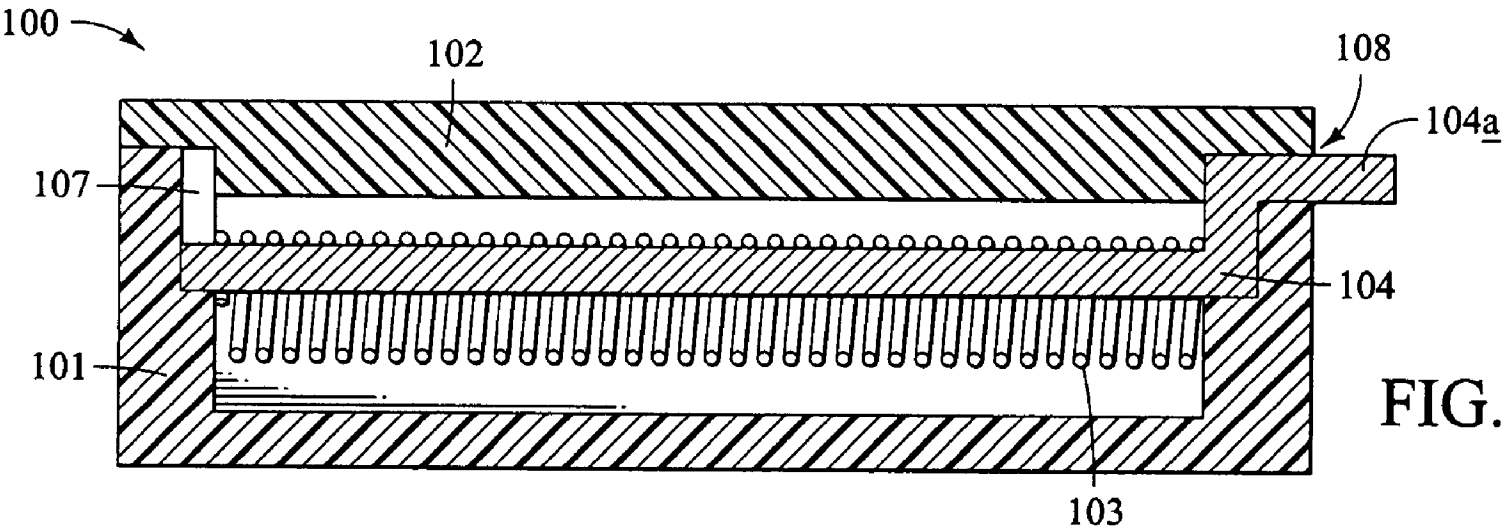
FIG. 11 is a side cross-sectional view of the embodiment of FIG. 9.
Figure 12:
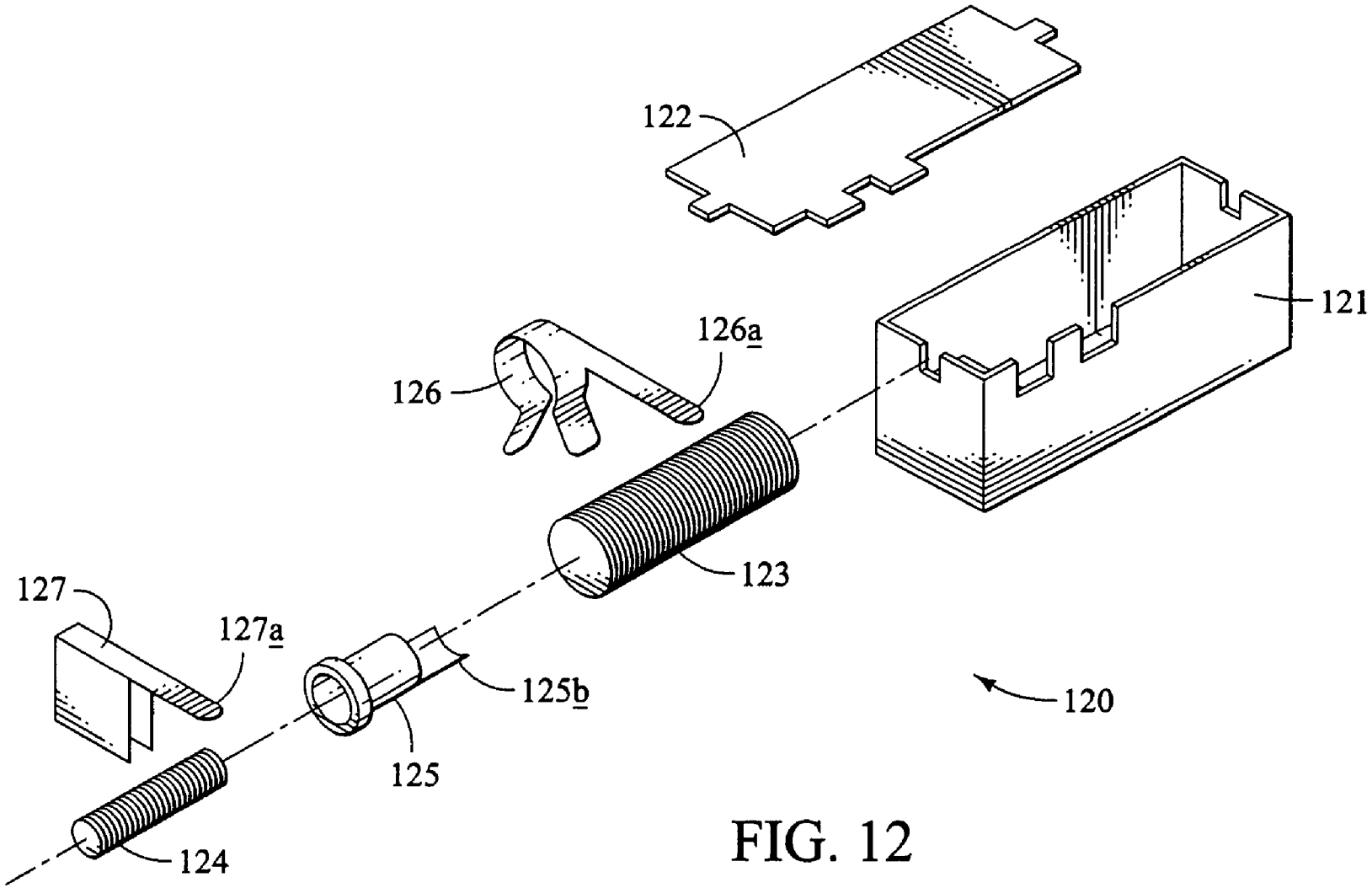
FIG. 12 is a perspective, exploded view of another embodiment of an inertia switch useful in flashing light systems.

Another embodiment of an inertia switch uses a double-spring arrangement, as depicted in FIGS. 9–11. The switch 100 includes a non-conductive or insulating housing 101 and cover 102, two conductive springs 103, 106, and two conductive rods 104, 105, each with an electrical contact 104*a*, 105*a*, on an end of the rod. Housing 101 has two slots 107 into which the non-contact end of rods 104, 105 fit. The housing also has two openings 108 through which contacts 104*a*, 105*a* protrude. After assembly of the switch itself, the switch is assembled by soldering or brazing the contacts 104*a*, 105*a*, into a flashing light system or other application. Other methods of assembly into a flashing light system may also be used, such as by press fitting or wave-soldering. When a user walks or moves, the springs jostle up and down on the rods, swinging up and down and side to side. When the springs contact each other, an electrical circuit is closed.

FIG. 11 is a cross-sectional side view of the switch, showing one way to assemble spring 103 and rod 104. Spring 103 is assembled onto rod 104 and inserted into housing 101. As shown in FIG. 9, there is a slot 107 at either end of the housing, into which slot the non-contact end of rod 104 fits; the contact end 104*a* protrudes through an opening 108 of housing 101. When the switch is at rest, the spring hangs down from the rod, as shown in FIGS. 10–11. The relative stiffness of the springs, axial or flexural, will not greatly affect the sensitivity of the switch depicted in FIGS. 9–11. Instead, the diameters of the rods and the springs, and the separation between the springs may have a greater effect on performance and sensitivity of the switch.

The springs and rods are assembled side-by-side in the housing, as shown in an end cross-section of a slightly different embodiment in FIG. 10. Inertia switch 110 comprises a nonconductive housing 111 and a nonconductive housing top 112. In this embodiment, housing top 112 has a boss 97 extending downwardly between the two springs and rods. This may help to prevent inadvertent contact between the springs in some instances. As shown in FIG. 10, springs 103, 106 may be coil springs, the coils having equal pitch and equal diameter d. The separation S between the centers of the springs must be at least one diameter d, otherwise the springs will be in constant contact, and the battery will wear out. On the other hand, if the springs are separated by a distance of twice the diameter or greater, they will never be in contact.

It has been found therefore, that the switch works better if the springs are separated in the housing by a distance greater than one diameter but less than two diameters. In a preferred embodiment, the springs are about 2 mm (0.08 inches) diameter and are separated by a little more than 2 mm (0.08 inches). If the springs are of different diameters, then the minimum separation is just more than one-half the sum of the two diameters, so that in the steady state the springs are not in contact; the maximum separation is just less than the sum of the two diameters. With these distances, coils can be brought into contact with vigorous shaking of the switch, caused by vigorous motion or movement by a person wearing shoes or another article into which the flashing light system and inertia switch is assembled.

While this embodiment features contacts 104*a*, 105*a* at opposite ends of the switch, other embodiments may also use two springs and rods, wherein the contacts are on the same side or end of the switch. Other designs may forego the use of springs in favor of thin solid or perforated cylinders of metal. Because the springs need only jostle and bounce as a whole, rather than bend or flex, cylinders will perform well in the application, as an insubstantial difference from the coil springs described above. All such designs are equivalents to the embodiment of FIGS. 9–11. There are other equivalents as well.

Another double-spring inertia switch 120 is depicted in FIGS. 12–15. The switch comprises an insulating housing 121 and insulating housing closure 122. The switch also comprises a smaller coil spring 124 and a larger coil spring 123, separated by an insulating directional sensing regulator 125. Regulator 125 has an elongated portion 125*b* for a portion of its outer circumference. The switch also has first contact 126 soldered to large spring 123, first contact 126 having an elongated portion 126*a* for connecting or assembling to an outside electrical circuit in which switch 120 is used. Switch 120 has a second contact 127 soldered to small spring 124. Second contact 127 has an elongated portion 127*a* for also connecting or assembling to a circuit in which switch 120 is used.

Figure 13:
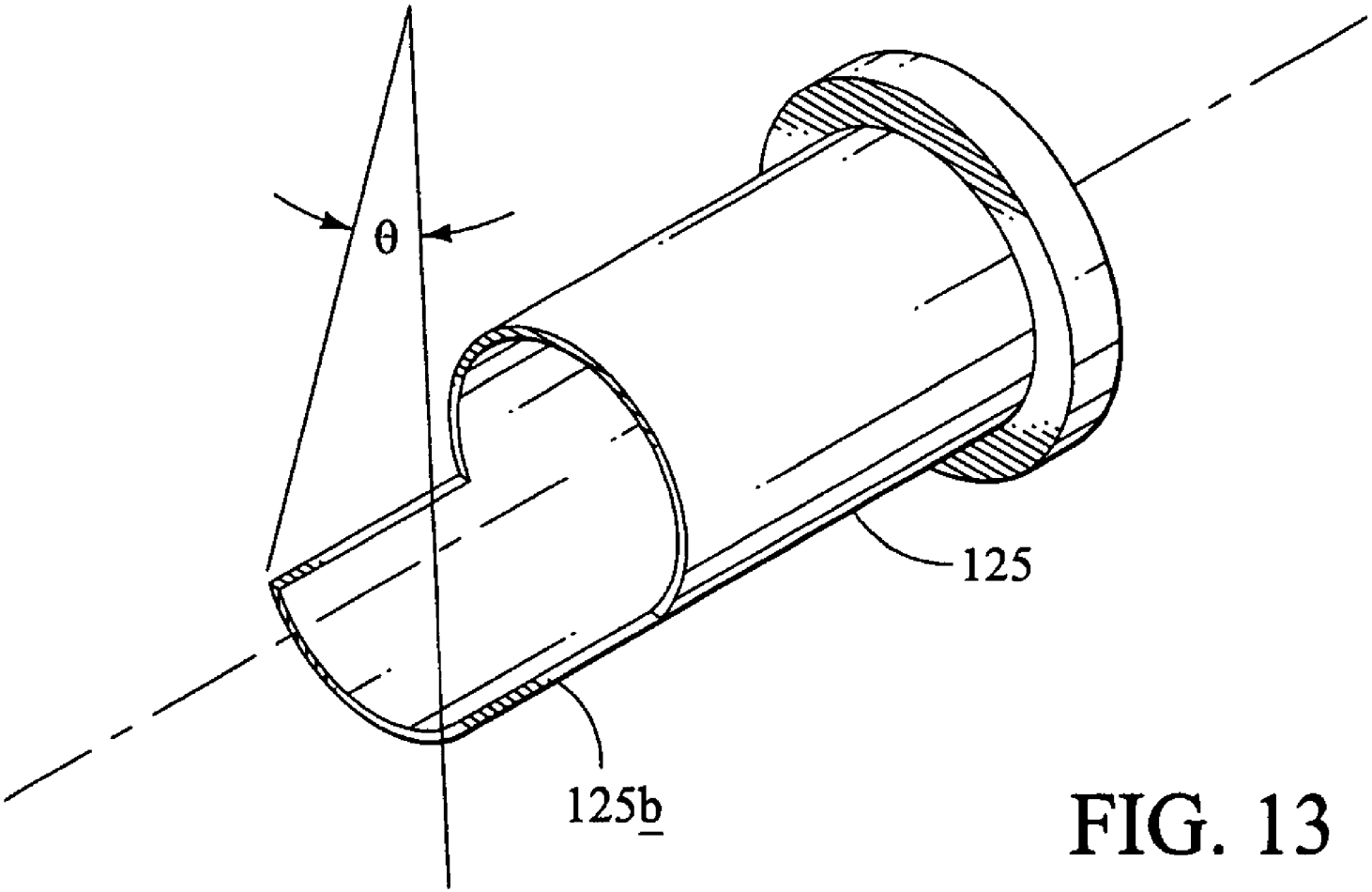
FIG. 13 presents a detailed perspective view of a component of the embodiment of FIG. 12.

A closer view of directional regulator 125 is seen in FIG. 13. Regulator 125 has a distal portion 125*b* longer than the remainder of the regulator, for a portion of its circumference, in this figure the portion portrayed as an angle θ. Thus, a portion of the circumference is elongated more than the remainder of the regulator. In one embodiment, the angle θ is about 25 degrees, and the elongation is about 5 mm (0.20 inches) on a regulator with an overall length of about 9 mm (0.35 inches).

Figure 14:
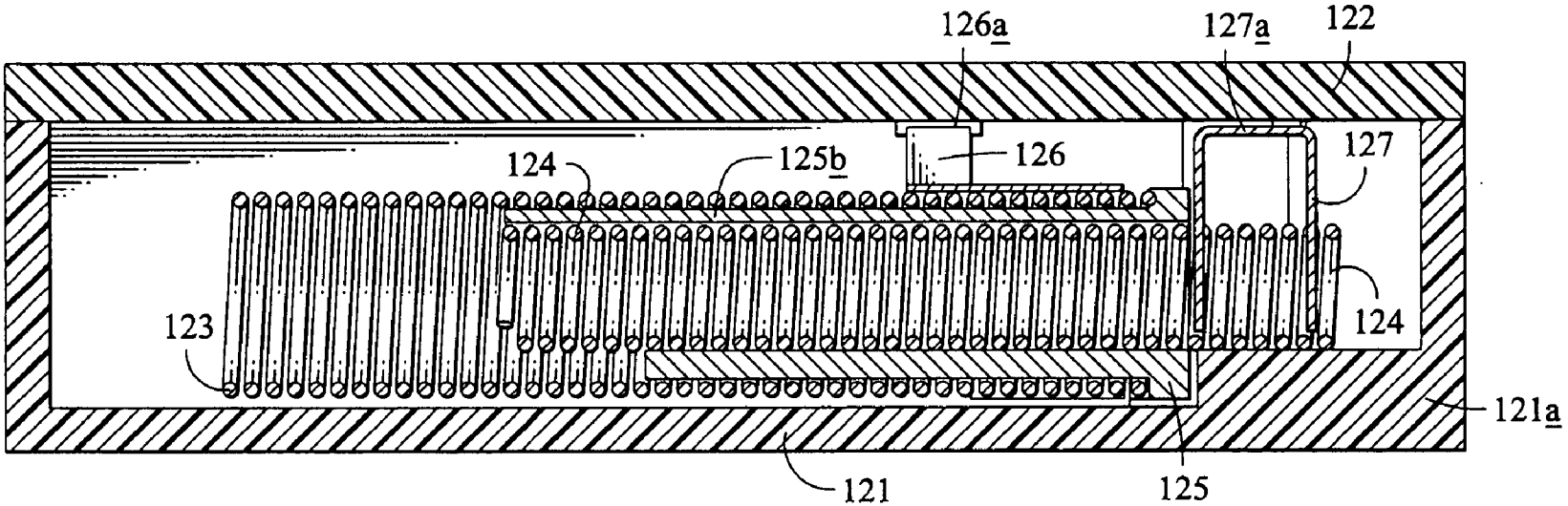
FIG. 14 is a partial cross-section of the embodiment of FIG. 12.

A partial cross-section of an assembled switch 120 is depicted in FIG. 14. Inner spring 124 is soldered to contact 127 and is located on a shelf 121*a* of housing 121. Small spring 124 is assembled inside regulator 125 which itself is assembled inside large spring 123. Large spring 123 is soldered to contact 126. A portion of contact 126 is not shown in cross-section for clarity in FIG. 14. Elongated portions 126*a*, 127*a* of the contacts extend to the top of housing 121 just under housing closure 122. Other methods of assembly besides soldering may be used; for instance, contact 126 may be simply compressed against spring 123 without soldering, or may be adhered to spring 123 with an adhesive.

In FIG. 14, regulator 125 is assembled with elongated portion 125*b* on top. This will prevent large spring 123 from contacting small spring 121 on a down-stroke, for instance, when large spring 123 moves downwardly. Note also that the cross section of regulator 125 is not necessarily uniform: the portion of regulator 125 on the bottom side of FIG. 14 is thicker than the portion of regulator 125 that is on the top side of FIG. 14. Note further, that as assembled in FIG. 14, it will not be possible for large spring 123 to move downwardly to contact inner spring 124, because the top surface of the bottom of housing 121 prevents almost all downward movement of large spring 123. However, large spring 123 can move upwardly because there is more clearance toward the top of housing 121. Thus, the walls of a portion of the regulator may be different, thicker or thinner, than the remainder of the walls of the regulator. The regulator is thus seen to be directional, i.e., its effect varies with its orientation in the switch. The switch in FIG. 14 is preferably installed upside-down from the view seen in the figure, with housing 121 on top and closure 122 on the bottom.

The touching of the two springs is thus controlled in several ways: the diameters of the springs, especially the large spring, the clearance between the outside of the spring and the top or bottom of the housing, as well as the length (left and right in FIG. 14, the extension of the coils of the spring) of spring available for extension and thus possible radial movement for contact with the small spring. Also controlling the contact is the upper and lower thickness of the regulator, as well as the length and circumferential extent (such as measured by an angle) of the regulator extension 125*b*. Note that large spring 123 is constrained in its movements by housing 121, large contact 126, and regulator 125 and extension 125*b*. Note also that as shown in FIG. 14, the movement of small spring 124 is constrained by contact 127, regulator 125, and shelf 121*a* of housing 121. Other embodiments may allow more movement of small spring 124 or large spring 123.

Inertia switch 120 is thus seen to have several variables which may be used to regulate contact between the springs, including the diameter and length of the springs, relative to one another and to the size and proportion of the directional regulator. Another way to control the contact is to rotate the regulator. So long as the circumferential extension is somewhat less than 360 degrees, switch 120 can thus be sensitive to the angular orientation of the regulator. Switch 120 is thus a directional sensing switch, with the switch sensitive to movement of at least one spring in the direction opposite to the orientation of an extension of regulator 125.

In addition to designing the orientation of the regulator, the thickness in one or more areas of the regulator, and the height of the shelf in the housing, may all be used to regulate the performance of inertia switch 120. The thickness of the regular may thus be used to control the radial separation of the springs from one another. In addition, the flexural stiffness and length of the springs in comparison to the regulator will determine the relative sensitivity of switch 120. Yet another way is to control the distance of both the larger and smaller spring from the housing and the closure. Yet another way is to control the distance either or both springs extend from the support shelf 121*a* of the regulator, if any. Either spring may thus be designed to have a greater freedom of movement or a lesser freedom of movement, to spring about to a greater or a lesser extent as a user moves and walks.

Figure 15:
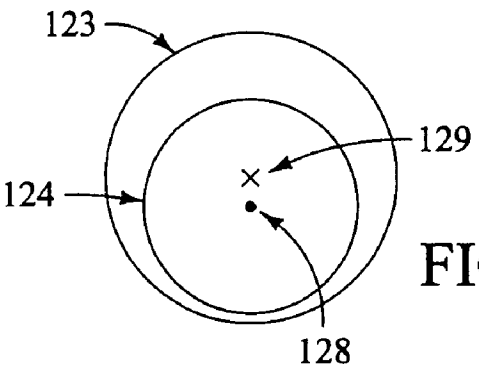
FIG. 15 is a schematic end view of the embodiment of FIGS. 12–14.
Figure 16:
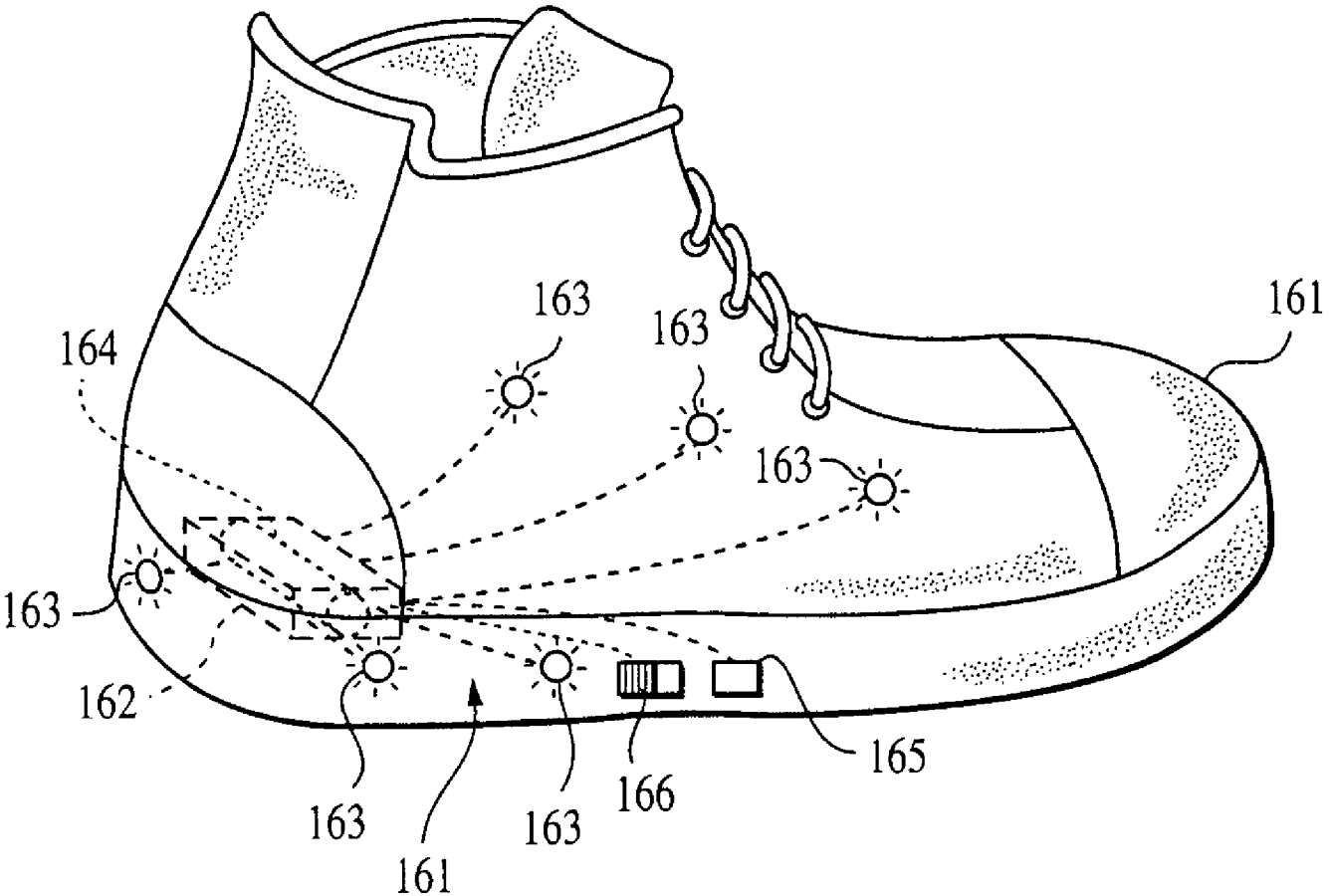
FIGS. 16–21 depict embodiments of articles using illumination systems with improved inertia switches.

FIG. 15 depicts an end view of the springs, denoting an additional variable that may be helpful in designing a directional spring switch. Larger spring 123 is centered on center 129, while smaller spring 124 is centered on center 128, and the two centers are not identical. In other embodiments, the springs may be concentric. The regulator may be concentric with the springs or may not be concentric.

Figure 17:
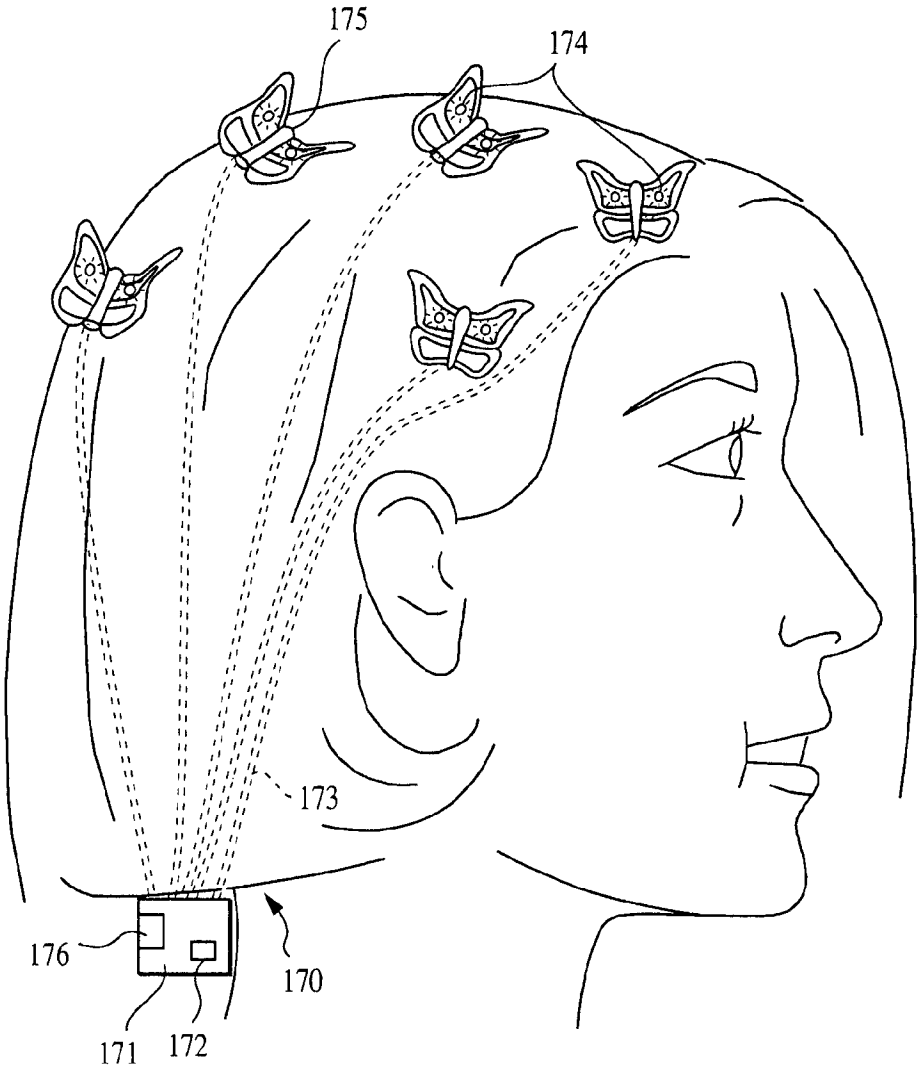

There are many applications for illuminating systems using inertia switches as described above. Such illuminating systems may be used on a variety of personal clothing and accessories. FIGS. 16–21 depict a few of these accessories, including FIG. 16, with a shoe 161 that incorporates the illuminating system 162 with LEDs 163, and having an inertial switch 164 and a touch switch 165. Either switch may be used to initiate or to change illumination patterns, as described above. The system also includes a toggle switch 166 for disconnecting the power supply (internal 3V battery) from the circuit. FIG. 17 depicts another application, using an LED in each of a plurality of hair clips for a woman. Illumination system 170 includes a system power and control portion 171 and an inertia switch 172 for turning the systems and LEDs on. The system includes a plurality of connector elements 173 connecting system controls 171 with LEDs 174 on hair clips 175. The control system may also have a toggle switch 176 to disconnect the battery from the rest of the circuit, conserving power.

Figure 18:
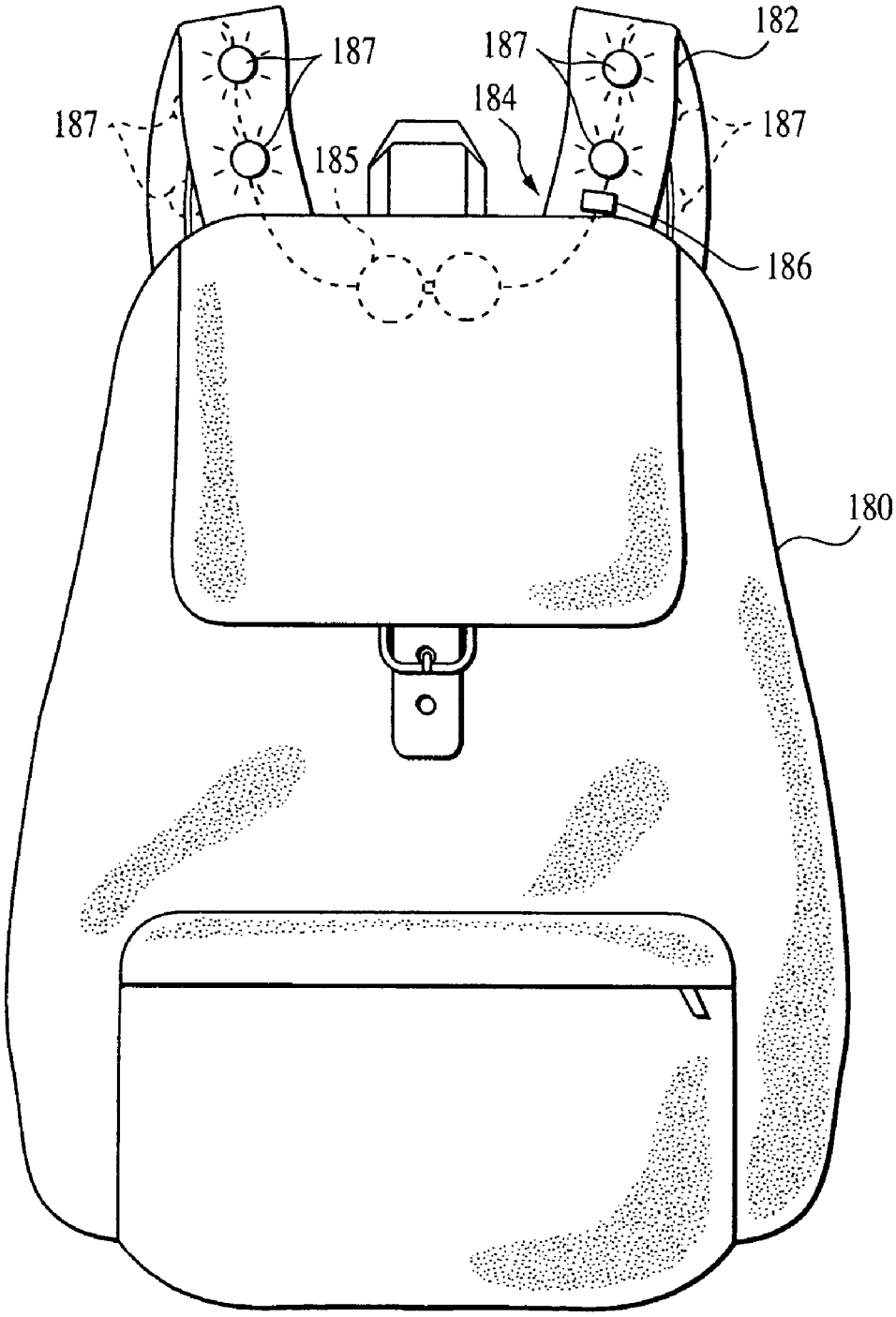

FIG. 18 depicts another application, a back pack 180 with straps 182 for displaying a plurality of flashing LEDs. In this application, the illumination system 184 includes a power and control portion 185, an inertia switch 186 for turning the system on and off, and a series of two-color (red/green) three-lead LEDs 187 on the straps of the backpack. The system power and control portion 185 may be contained in the top flap of the backpack. In this application, the control system may be programmed to alternate red-color LEDs on the left side with red-color LEDs or green-color LEDs on the right side, or vice-versa, in sequence. Of course, two-color LEDs in other colors may also be used, any colors commercially available, and there is no intention to limit this application to two-color LEDs alone. Single-color LEDs may also be used. This is also a good application for in-phase illuminating, in which the LEDs closest to the pack are illuminated, and then the middle pair, and finally the pair farthest away form the back pack, and so on. Other sequences or random flashing may also be used.

Figure 19:
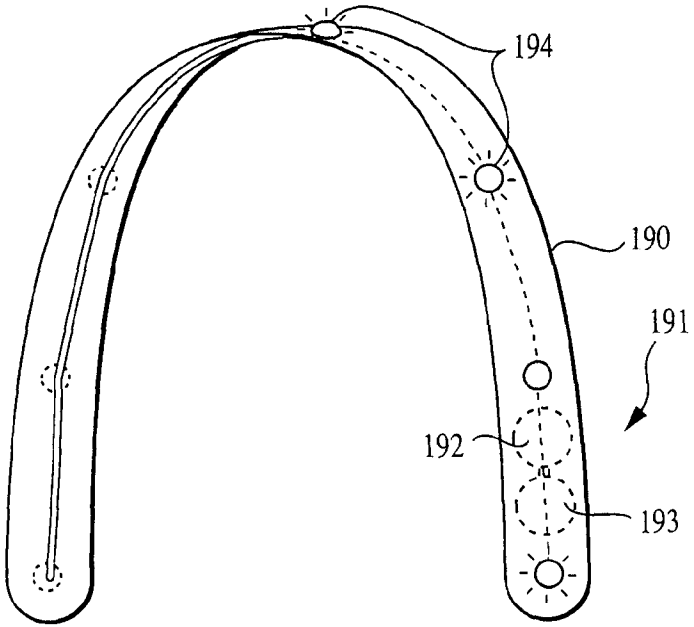
Figure 20:
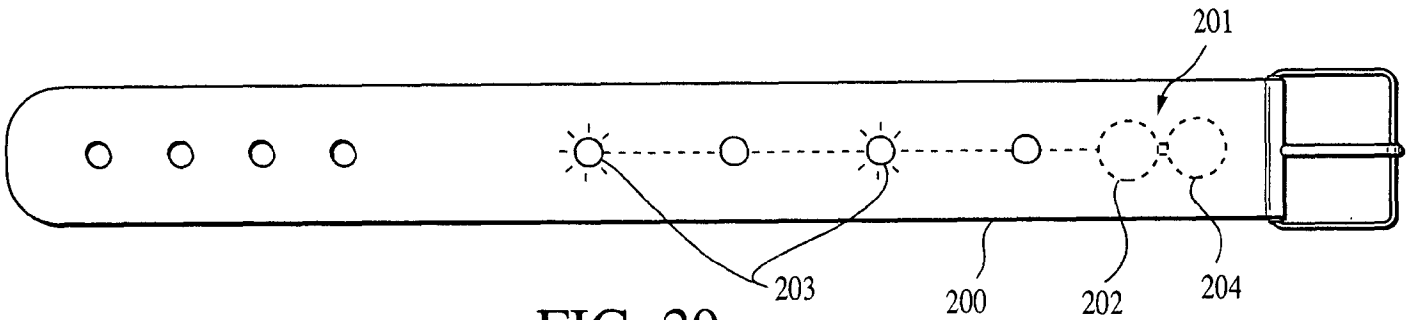
Figure 21:
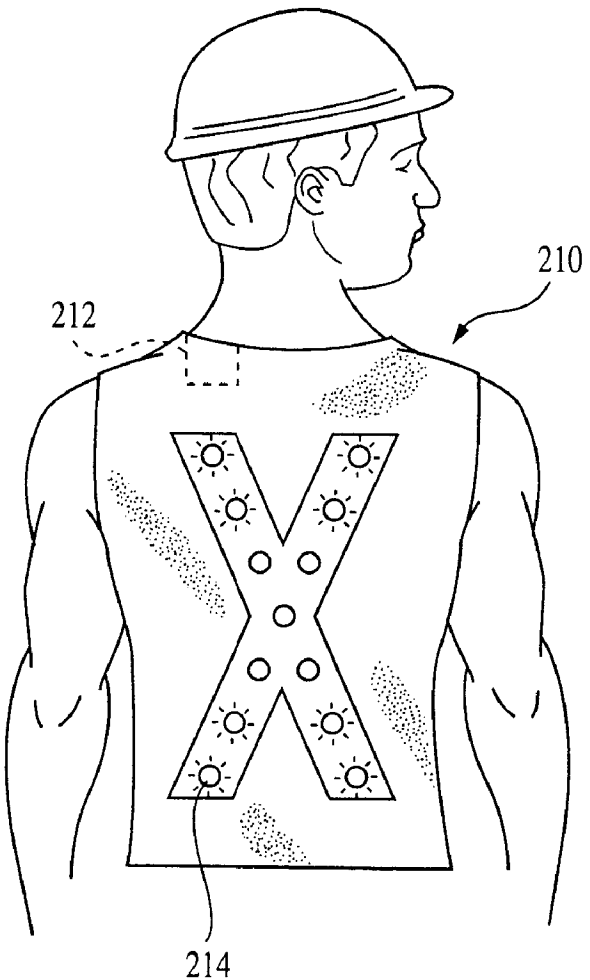

Other accessories which may desirably employ embodiments of a flashing light system include the hairpiece of FIG. 19, a belt, as shown in FIG. 20, and a garment, such as a safety vest for a highway construction worker, shown in FIG. 21. The hairpiece 190 is desirably made of plastic in an attractive and stylish fashion. There may be niches in the underside of the piece to accommodate the power and control portion 192, including an inertia switch (not shown) of the illuminating system 191. It may also be convenient to mold in at least one niche for a control switch 193 for a user to control the illumination or flashing patterns of the system 191. The LEDs 194 are then displayed on the top-side of the hair piece for decorative and stylistic purposes. A belt 200 may also incorporate a system 201 of flashing lights 203. In this application, the belt has a small space on its underside for attachment of the control system 202 (including an inertia switch) and power supply 204. The LEDs 203 are also strung on the underside and protrude through to the outside of the belt. FIG. 21 depicts a highway worker wearing a safety vest with a flashing light system 210, including control and power supply portions 212 and a pattern of lights 214 in the shape of a large "X" on the vest. Other garments may also be equipped with a flashing light system, such as a coat, a pair of pants, or a protective suit. Any of these circuits may incorporate the features discussed above, including bi-color LEDs, a toggle-switch to turn off the circuit, and an inertia switch to increment and control the flashing.

The above descriptions demonstrate that the new inertia switches may take on a variety of forms. The switches may be made in many configurations, allowing a designer freedom in designing and configuring the switches. The switches may be manufactured and installed to take advantage of directional sensitivity, and may also be assembled with a variety of techniques. These inertia switches are small and may be designed for the amount of current or voltage carrying capacity needed by selecting appropriate materials and thicknesses for current or voltage paths. These switches thus enable better flashing light systems, adding to the interest, fun, and safety of physical activity and exercise when using footwear or other personal accessories with flashing light systems.

It is intended that the foregoing detailed description be regarded as illustrative rather than limiting, and that it be understood that it is the following claims, including all equivalents, that are intended to define the spirit and scope of this invention. Any of the several improvements may be used in combination with other features, whether or not explicitly described as such. Other embodiments are possible within the scope of this invention and will be apparent to those of ordinary skill in the art. For instance, while some circuits have been described using single-color LEDs, bi-color or tri-color LEDs may also be used. While many of the circuits are useful in flashing light systems with a single battery or voltage source, more than one battery may be used, such as two or even three batteries, acting alone as voltage sources or connected in series for a higher voltage. Therefore, the invention is not limited to the specific details, representative embodiments, and illustrated examples in this description. Accordingly, the invention is not to be restricted except in light as necessitated by the accompanying claims and their equivalents.

The invention claimed is:

1. A flashing light system and an inertia switch, comprising:

a flashing light system mounted in footwear, an article of clothing, or a personal accessory worn by a user;

an inertia switch connected to the flashing light system, the inertia switch comprising an insulating housing;

a first and a second contact mounted side by side in the housing; and a first magnet mounted to the housing and a second magnet disposed within the housing, the first magnet and the second magnet opposed by a repulsive force between the magnets, wherein the switch is normally open and motion of the user causes the second magnet to move, contacting both contacts and closing the switch.

2. The flashing light system and inertia switch of claim 1, further comprising a mass connected to the second magnet.

3. The flashing light system and inertia switch of claim 1, further comprising a controller having a memory for storing patterns of flashing.

4. The flashing light system and inertia switch of claim 1, wherein the magnet is electrically conductive.

5. The flashing light system and inertia switch of claim 4, wherein the flashing light system farther comprises a plurality of LEDs, a controller, and a power source.

6. The flashing light system and inertia switch of claim 4, wherein the flashing light system further comprises at least two voltage sources and at least one LED connected to the at least two voltage sources, wherein the flashing light system applies at least two voltages sequentially to the at least one LED.

7. A method of controlling a flashing light system, the method comprising:

assembling a flashing light system comprising an inertia switch according to claim 1; and mounting the flashing light system in an item selected from the group consisting of footwear, an article of clothing, and a personal accessory, wherein the flashing light system may be activated by causing motion of the inertia switch.

8. A method of making a flashing light system, the method comprising:

making an inertia switch according to claim 1;

assembling the inertia switch into a flashing light system; and installing the flashing light system into an item selected from the group consisting of footwear, an article of clothing, and a personal accessory.

9. The method of claim 8, further comprising controlling flashing of the system using a controller and patterns of flashing stored in a memory of the system.

10. The flashing light system and inertia switch of claim 1, further comprising a touch switch or a toggle switch.

11. The flashing light system and inertia switch of claim 1, further comprising a RC control circuit.

12. A method of controlling a flashing light system, the method comprising:

mounting two conductors side by side in an insulating housing;

placing a first magnet and a second magnet in the housing, the first magnet and the second magnet opposed by a repulsive force between the magnets to form an inertia switch for a flashing light system; and closing the inertia switch through motion of the switch, causing the first magnet to contact both contacts simultaneously and activate the flashing light system.

* * * * *